US005454771A

United States Patent [19]

Wilson-Hyde

[11] Patent Number: 5,454,771

[45] Date of Patent: Oct. 3, 1995

[54] STEP AEROBIC PLATFORM

[76] Inventor: Cynthia Wilson-Hyde, 4931 SW. 95 Ave., Miami, Fla. 33165

[21] Appl. No.: 271,438

[22] Filed: Jul. 7, 1994

[51] Int. Cl.[6] ..... A63B 22/04

[52] U.S. Cl. ..... 482/52; 482/51; 248/240.4; 297/423.4

[58] Field of Search ..... 297/331, 118, 297/423.4; 482/123, 148, 51–53, 66, 67, 38–42, 27–29, 123, 141, 142, 148, 904; D6/350; 4/579, 578.1, 551, 548, 585–587; 248/240.4

[56] References Cited

U.S. PATENT DOCUMENTS

| | | | |
|---|---|---|---|
| D. 157,436 | 2/1950 | Rogers | D6/350 |
| D. 331,808 | 12/1992 | Paul et al. | D6/350 |
| 2,670,029 | 2/1954 | Rossi | 4/578.1 |
| 2,813,276 | 11/1957 | Lanza | 4/579 |
| 2,829,705 | 4/1958 | Godshalk et al. | 297/423.41 |
| 3,628,791 | 12/1971 | Garcia . | |
| 4,289,308 | 9/1981 | Allen et al. . | |
| 4,549,732 | 10/1985 | Hoffman . | |
| 4,639,037 | 1/1987 | Maruyama | 248/240.4 |
| 4,705,028 | 11/1987 | Melby . | |
| 4,743,008 | 5/1988 | Fermaglich . | |
| 4,984,785 | 1/1991 | Wilkinson . | |
| 4,986,532 | 1/1991 | DeCloux . | |
| 5,137,240 | 8/1992 | Van Meter | 248/240.4 |
| 5,277,684 | 1/1994 | Harris | 482/123 |

FOREIGN PATENT DOCUMENTS

| | | | |
|---|---|---|---|
| 471366 | 3/1952 | Italy | 297/331 |
| 77529 | 4/1954 | United Kingdom | 4/579 |

*Primary Examiner*—Jerome Donnelly
*Attorney, Agent, or Firm*—Basile and Hanlon

[57] ABSTRACT

An improved step aerobic platform comprises handrails and a foldable seat that locks in an upright position when in use, and can be retracted and folded against said handrails when not in use.

4 Claims, 1 Drawing Sheet

STEP AEROBIC PLATFORM

FIELD OF THE INVENTION

This invention relates to a modified step aerobic platform having a support structure with a retractable seat.

BACKGROUND OF THE INVENTION

Step aerobics wherein a person steps on and off a slightly elevated platform has become an important form of exercise in recent years. Step aerobics provides a cardiovascular workout with minimal investment of equipment such that a wide spectrum of persons can enjoy this form of exercise. Although many people own and use a step aerobic platform, current exercise equipment that consist strictly of a raised platform is inadequate to be used by the elderly or physically challenged individuals. The current step aerobic platform offers no support or balance system to minimize the chance of an individual falling.

SUMMARY OF THE INVENTION

The current invention provides an improved step aerobic platform having laterally spaced handrails and an integral seat that may be positioned up or down. The handrails assist the elderly and the physically challenged individual to step onto and off the step aerobic platform and to maintain balance while on the platform. The integral seat provides further support during sitting portions of the exercise. The seat comprises two half side portions that meet at the center to form the bench-like seat. The one-half portion of the seat at each side is pivotally connected to the handrails. Hinging means attached to portions of the seat and the handrails provide a locking mechanism to hold the seat in its upright usable position. When the seat is in its upright usable position, exercise can be continued in a sitting position. If the seat is no longer required, the hinges can be unlocked so that the seat portions will pivot back toward the lower portion of the handrail to rest against the handrail so that they are out of the way for further stand-up step aerobics.

It is an object of the invention to have this combination of a handrail and integral seat on an elevated step aerobic platform to provide support for an individual while stepping onto and off the elevated platform. It is further an object of this invention to provide support for an individual while on the elevated platform. Finally, it is an object to provide a support for times during the exercise period when exercise can be done in a sitting position. Therefore, this invention provides for a compact step aerobic exerciser that can be used by all exercisers including the elderly and physically challenged individuals.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
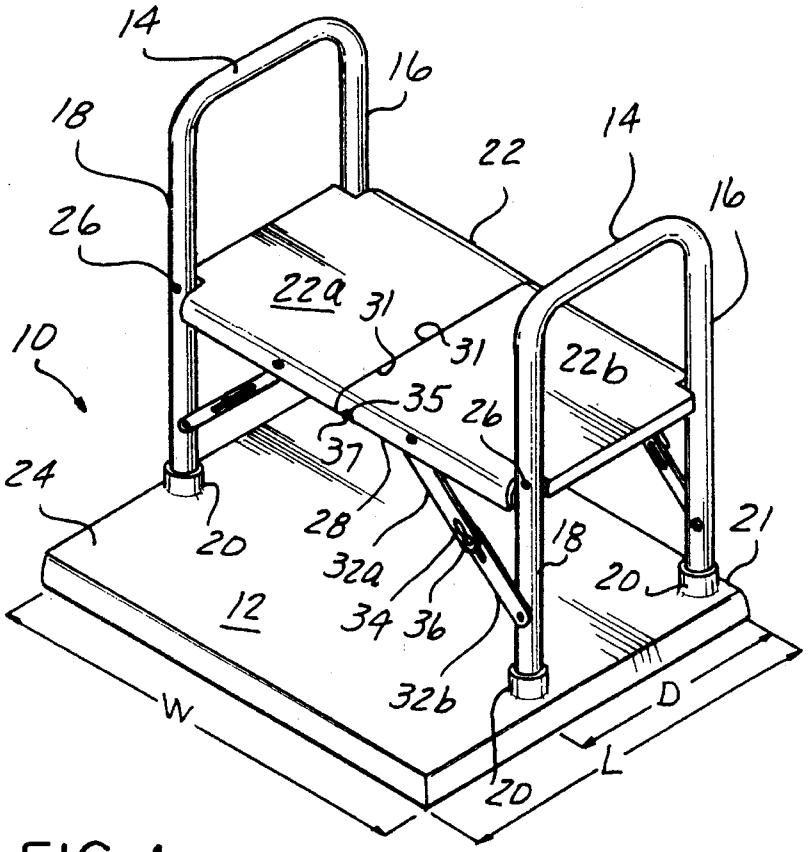
FIG. 1 is a perspective view of the improved step aerobic platform illustrating handrails and a retractable seat in an upright usable position.
Figure 2:
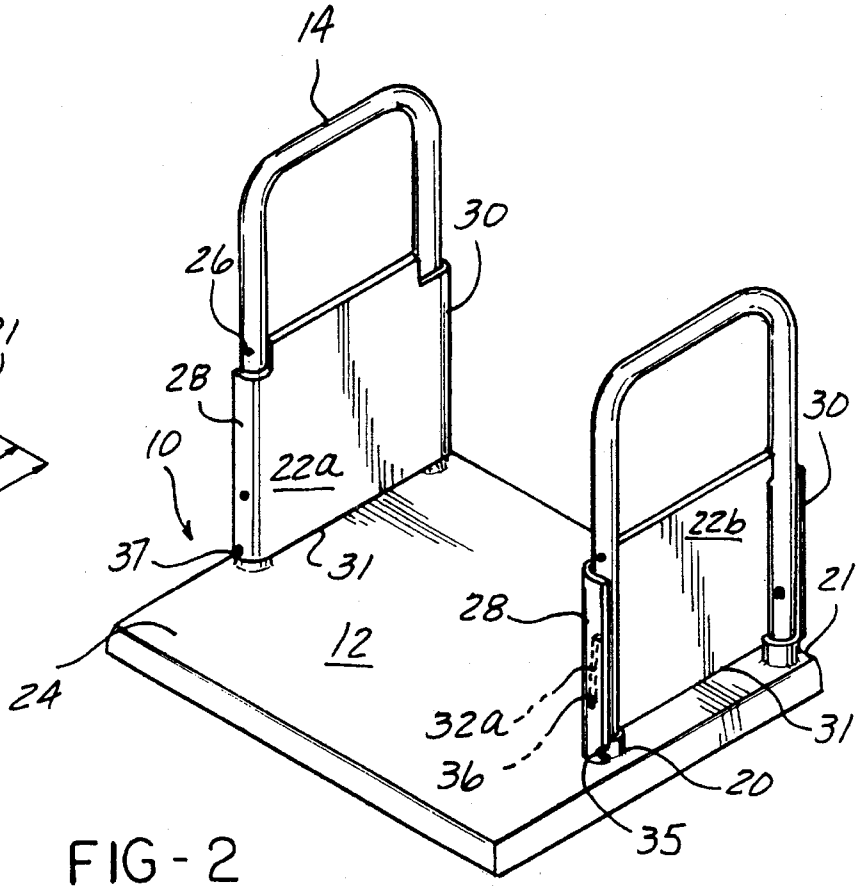
FIG. 2 is a perspective view of the modified step aerobic platform illustrating the seat in a retracted position.

Referring to FIGS. 1 and 2, the improved step aerobic platform 10 is generally rectangular shaped box, having two opposing sides longer than their adjacent other two sides. For convenience, the longer sides will be referred to as the width (W) and the shorter sides will be referred to as the length (L). A facing surface 12 is the horizontal surface of the platform that defines the area for placement of the feet of a user while utilizing the platform 10. A pair of laterally spaced tubular U-shaped handrails 14 are fixedly secured to the facing surface 12 of the elevated platform. The handrails 14 may be at any height to accommodate the individual user. Each handrail 14 has a back vertical leg 16 and a front vertical leg 18. All four legs may be secured into individuals flanges 20 extending above the platform facing surface 12. The back vertical legs 16 of the handrails 14 are positioned to be in lateral corners 21 of the platform. Spaced forward from these back vertical legs, and along the length (L) of the platform 10 are secured the front vertical legs 18. The distance (D) of the respective back vertical legs 16 to the front vertical legs 18 defines the depth of an integral seat 22 to be discussed further. The distance (D) is less than the length (L) so that there is an open area 24 forward from the front vertical legs 18 that can accommodate feet of the user while sitting on the integral seat.

The integral seat 22 is formed by two half portions **22*a*, 22*b* pivotally connected on the vertical legs 16, 18 of the handrail. Screws 26 or other means may be used to attach one side end of each seat portion to the vertical legs 16, 18 of the handrails. The front 28 and rear 30 edges of the seat portions 22*a*, 22*b* are curved to correspond to the curvature of the tubular vertical legs 16, 18 of the handrails. The curved front and rear edges 28, 30 also provide a smooth edge against which the user can placed his legs when sitting on seat 22. As seen in FIG. 2, when the seat portions 22*a*, 22*b* are folded or retracted in a storage position, the curve front 28 and rear 30 edges curve around the tubular vertical legs of the handrails so that the seat portions 22*a*, 22*b* set vertically flush against the vertical legs 16, 18. The lower edges 31 of each seat portion are adjacent to the facing surface 12 when in the retracted or storage position. The lower edges 31 are juxtaposed and abut when seat 22 is in the upright usable position. The seat portions may also slightly overlap so that a groove 35 near edge 31 of one seat portion 22*b*, latches over a corresponding protrusion 37 on the other seat portion 22*a***.

Locking means of any conventional method may be used to lock the seat portions **22*a*, 22*b* into the upright usable position. In the embodiment shown in FIGS. 1 and 2, a pair of links 32*a*, 32*b* are hinged together at a slotted area 34. One end of one link 32*a* is rotatably mounted to a front 28 or rear 30 edge of a seat portion 22*a*, 22*b*. A second link 32*b* is rotatably mounted to a lower portion of the adjacent vertical leg 16, 18. This is repeated for all four vertical legs at four locations along the front and rear edges of the seat portions. The slotted area 34 of the hinge allows for a pin 36** to travel within the slot as the seat portion moves from a retracted, stored position to an upright position. Although one form of locking means has been described, it is understood that other conventional hinge locks, such as those used for folding chairs, could be used.

When the seat portions **22*a*, 22*b* are locked in an upright usable position, a seat 22 is formed providing a support for an individual to continue doing exercise that can be done in a seated position. The handrails can be used for support for such exercises as leg lifts while the individual is seated. When the seat portions 22***a*, 22*b* are in the retracted position (FIG. 2), and resting against their respective handrail, the step aerobic platform 10 can be used for stepping exercises with the handrails 14 used for support. Therefore, this invention provides a compact step exercise platform that can be used by elderly as well as the physically disabled or challenged individuals.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An improved aerobic step platform of the type consisting of an elevated essentially rectangular box, the box having an exposed upper surface for placement of the feet of a user, wherein the improvement comprises:

two handrail means, being securely mounted along opposing lengths of said exposed upper surface, each handrail means comprising at least one vertical leg extensions;

a foldable seat;

said seat comprising two seat halves;

each seat half comprising a first end and a second end; and each seat half being pivotally mounted to a respective one of said at least one vertical leg extensions at a first end and pivotal into a horizontal position, wherein each of said seat halves second ends face each other to form a substantially continuous seat surface which extends between said two handrail means.

2. The improved aerobic step platform as defined in claim 1, wherein the vertical leg extensions are generally tubular in shape, and the seat has a rounded front and back edge to correspond with the tubular leg extensions when the seat is in a folded stored position.

3. The improved aerobic step platform as defined in claim 2, wherein the seat comprises means for locking the seat in the horizontal position.

4. The improved step platform as defined in claim 3 wherein the position of the vertical leg extensions provide an open area on the exposed upper surface for accommodating the feet of the user when the seat is in the horizontal position.

* * * * *